United States Patent [19]

Gotoh

[11] Patent Number: 4,745,713

[45] Date of Patent: May 24, 1988

[54] PREFABRICATED PC SHELTER STRUCTURE

[76] Inventor: Yoshiharu Gotoh, at Nihon Samicon Company Ltd., 1-8-23 Bentenbashidori, Niigata, Japan

[21] Appl. No.: 14,296

[22] Filed: Feb. 13, 1987

[51] Int. Cl.[4] ..... E04B 1/32

[52] U.S. Cl. ..... 52/88; 52/223 R; 52/227; 52/86

[58] Field of Search ..... 52/80, 82, 86–89, 52/600–602, 722–724, 741, 745, 747, 223 R, 227, 224

[56] References Cited

U.S. PATENT DOCUMENTS

| | | | |
|---|---|---|---|
| 893,640 | 7/1908 | Moccetti | 52/88 |
| 2,129,932 | 9/1938 | Huddleston | 52/88 |
| 3,057,119 | 10/1962 | Kessler | 52/89 X |
| 3,173,226 | 3/1965 | Solnick | 52/89 |
| 3,256,653 | 6/1966 | Huff | 52/89 |
| 3,464,168 | 9/1969 | Russell et al. | 52/227 X |
| 4,015,383 | 4/1977 | Crowley | 52/224 |
| 4,071,985 | 2/1978 | Wickwire | 52/86 |
| 4,432,174 | 2/1984 | Smith | 52/224 |
| 4,458,457 | 7/1984 | Heierli | 52/89 X |
| 4,555,888 | 12/1985 | Goldenberg et al. | 52/602 |
| 4,558,969 | 12/1985 | FitzSimons | 52/89 X |

FOREIGN PATENT DOCUMENTS

| | | | |
|---|---|---|---|
| 138004 | 7/1950 | Australia | 52/86 |
| 501970 | 5/1954 | Canada | 52/86 |
| 1020175 | 11/1957 | Fed. Rep. of Germany | 52/88 |
| 1178261 | 1/1970 | United Kingdom | 52/86 |
| 141609 | 12/1961 | U.S.S.R. | 52/86 |

*Primary Examiner*—J. Karl Bell

*Attorney, Agent, or Firm*—Steele, Gould & Fried

[57] ABSTRACT

Herein disclosed are a generally arched, prefabricated PC shelter structure, a pair of unit half plates for forming an arched unit together to construct the arched shelter structure when a plurality of pairs are fastened together side by side, and a process for prefabricating the paired unit half plates together. The shelter structure is constructed of a plurality of pairs of unit half plates prefabricated of highly strong concrete. Any paired two of the unit half plates are peripherally curved to form the generally arched unit together when they are assembled to have their tops abutting against each other. Peripherally fastening means is incorporated for peripherally fastening the abutting tops of the paired two unit half plates together to form the generally arched unit. Transversely fastening means is also incorporated for transversely fastening a plurality of generally arched units, which are arranged side by side, together to construct the generally arched PC shelter structure. The legs of the paired two unit half plates are anchored at the foundations of the field.

24 Claims, 6 Drawing Sheets

PREFABRICATED PC SHELTER STRUCTURE

BACKGROUND OF THE INVENTION

1. Field of the Invention

The present invention relates to a snowbreak or windbreak shelter to be laid and erected on a road or railway and, more particularly, to an arched, prestressed concrete (which will be abbreviated as customary to "PC") shelter structure, a pair of unit half plates for forming an arched unit together to construct the arched shelter structure when a plurality of pairs are fastened together side by side, and a process for prefabricating the paired unit half plates together.

2. Description of the Prior Art

In the prior art, a shelter made of steel is laid and erected in the field. This execution of construction is troubled by an extension of term and an increase in cost and has to blockade the traffic over a long period of time. In addition, the shelter requires a very heavy expenditure for its maintenance, management and repairs because it is made of steel and will heavily corrode.

SUMMARY OF THE INVENTION

An object of the present invention is to provide a light-weight prefabricated PC shelter structure which can be laid and erected in the field for a short term so that it will hardly blockade the traffic.

Another object of the present invention is to provide a strong shelter structure which is reinforced as a whole by a number of PC steel bars.

Still another object of the present invention is to provide a shelter structure which is made firm against an external force by using the PC steel bars effectively.

A further object of the present invention is to provide a prefabricated PC shelter structure which uses a number of generally arched units to fit the windings, undulations and grades of a road.

A further object of the present invention is to provide a prefabricated PC shelter structure which is voidless and excellent in strength and appearance.

A further object of the present invention is to provide a pair of unit half plates for forming an arched unit together to construct the PC arched shelter structure when a plurality of pairs are fastened together side by side.

A further object of the present invention is to provide a process for prefabricating the paired unit half plates together.

According to a feature of the present invention, there is provided a generally arched, prefabricated PC shelter structure comprising: a plurality of pairs of unit half plates prefabricated of highly strong concrete, any paired two of said unit half plates being peripherally curved to form a generally arched unit together when they are assembled to have their tops abutting against each other; peripherally fastening means for peripherally fastening the abutting tops of said paired two unit half plates together to form said generally arched unit; transversely fastening means for transversely fastening a plurality of generally arched units, which are arranged side by side, together to construct a generally arched PC shelter structure; and anchor means for anchoring the legs of said paired two unit half plates to foundations.

According to another feature of the present invention, there is provided a pair of unit half plates prefabricated of highly strong concrete and curved peripherally to form a generally arched unit together, when they are fastened at their tops abutting against each other, thereby to construct a generally arched PC shelter structure when a plurality of generally arched units are arranged side by side and fastened transversely together.

According to still another feature of the present invention, there is provided a process for prefabricating together a pair of unit half plates of highly strong concrete, which are curved peripherally to form a generally arched unit together, when they are fastened at their tops abutting against each other, thereby to construct a generally arched PC shelter structure when a plurality of generally arched units are arranged side by side and fastened transversely together, comprising the steps of: (a) pumping highly strong concrete into an arching form, which is assembled from a top form frame, a bottom form frame and side form frames to have both an internal space for forming said generally arched unit and a plurality of placing ports arranged peripherally on said top form frame at a predetermined interval and opened into said internal space, through the lowermost one of said placing ports at one side substantially up to the level of said lowermost placing port; (b) covering said lowermost placing port; (c) pumping said concrete into said arching form through the next one of said placing ports substantially up to the level of said next placing port; (d) covering said next placing port; (e) repeating the pumping step (c) and the subsequent covering step (d) at said one side except for the top placing port; (f) repeating the steps (a) to (e) consecutively for the other side of said arching form; (g) positioning a top form plate at the peripheral center of said top placing port; and (h) pumping said concrete into said arching form through said top placing port.

BRIEF DESCRIPTION OF THE DRAWINGS

Other objects, features and advantages of the present invention will become apparent from the following description taken in connection with four embodiments thereof with reference to the accompanying drawings in which.

DETAILED DESCRIPTION OF THE INVENTION

The present invention will be described in the following in connection with the embodiments thereof with reference to the accompanying drawings.

Figure 1:
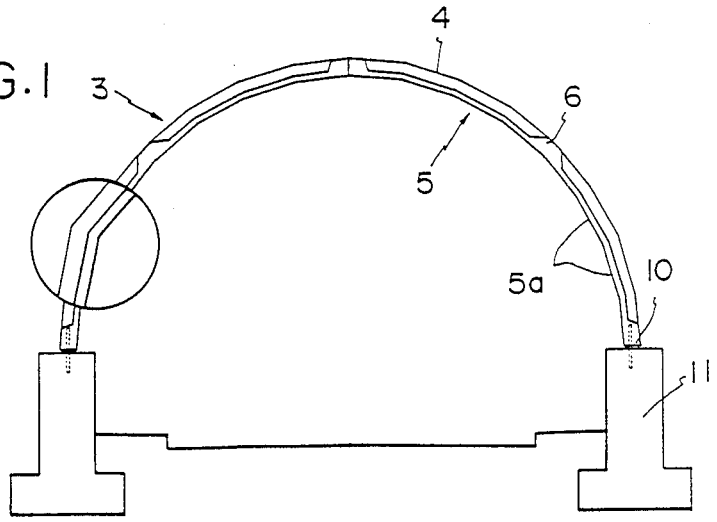
FIG. 1 is a front elevation showing the whole structure of an arched PC shelter structure according to a first embodiment of the present invention.
Figure 2:
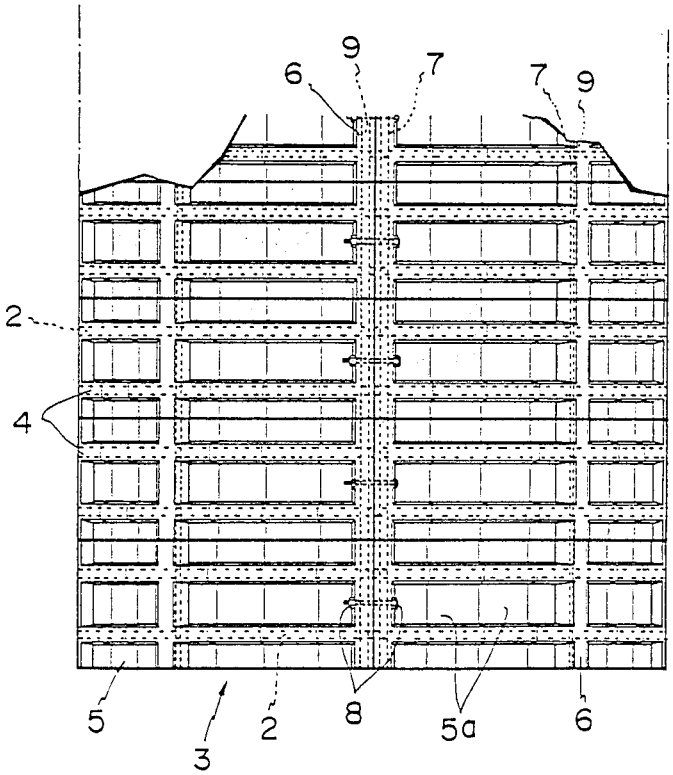
FIG. 2 is a top plan view showing a portion of the PC shelter structure of FIG. 1.
Figure 3:
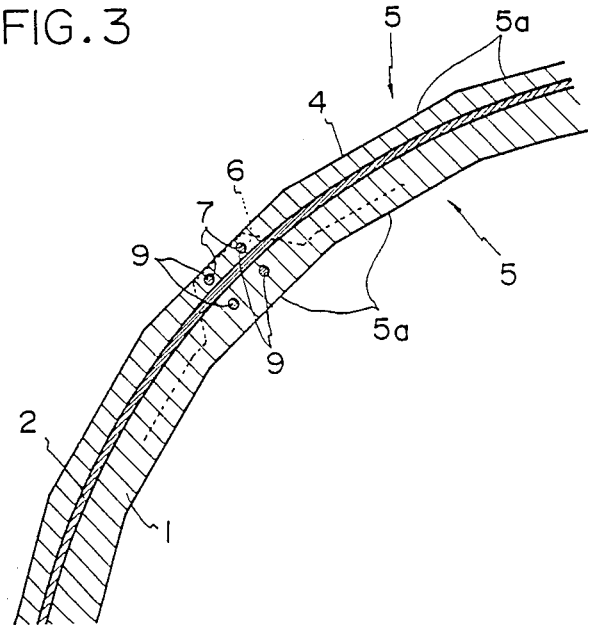
FIG. 3 is an enlarged longitudinal section showing a portion of a unit half plate of the PC shelter structure of FIGS. 1 and 2.

According to a first embodiment of the present invention, as shown FIGS. 1 to 3, a number of PC unit half plates 3 are prefabricated at a factory. Each of these unit half plates 3 is formed of highly strong concrete 1 and tensed by unbonded PC steel bars 2. The unit half plate 3 may be formed on its outer face with peripheral (or longitudinal) ribs 4, which extend all over the length in a curving direction, and on its inner and outer faces with a number of planes 5*a* to form together with the pairing half plate 3 a generally arched multiplanar unit 5 which has an arched portion of a polygonal section in the curving or longitudinal direction. In each of the ribs 4, there is buried the unbonded PC steel bar 2 which is tensed by a post-tension and fastened at its two ends by means of not-shown nuts. The unit half plate 3 is further formed on its outer face with a plurality of transverse ribs 6 which extend all over the width in a transverse direction perpendicular to the curving direction. Each of these transverse ribs 6 is formed with a duct 7.

In the field, a desired number of the unit half plates 3 thus prefabricated are temporarily assembled to abut against one another in the curving longitudinal direction and in the transverse directions. The unit half plates 3 in each pair are fastened at their upper ends or tops to each other in their curving longitudinal direction by means of a peripheral fastener 8 such as a combination of a bolt and a nut. The unit half plates 3 of the desired number adjoining side by side are fixed in their transverse direction, i.e., in the longitudinal direction of the resultant arched PC shelter structure by threading a desired number of transversely fastening PC steel bars 9 into the individual ducts 7 and by fastening the steel bars 9. Here, these steel bars 9 to be suitably used may be either unbonded PC ones which are coated with asphalt or tar so that they may not be wetted with the concrete or post-tension PC ones which use sheaths. On the other hand, the unit half plate 3 may be made of fiber-reinforced high strong concrete. The unit half plate 3 has its lower end (or leg) 10 is positioned on a support mounted on a foundation 11 and is hinged to the foundation 11 by means of anchor bolts. In an alternative, the unit half plate 3 may be equipped at its abutting top with an elastic member and formed at its leg with a hinge structure by burying in the foundation 11 a concrete hinge preformed in the unit half plate 3.

Thus, a light-weight prefabricated PC shelter structure can be easily laid and erected in the field without substantially blockading the traffic. This prefabricated PC shelter structure can be made firm because it is monolithically constructed of the numerous PC steel bars 2 and 9 in the curving longitudinal and transverse directions of the unit half plates 3. Since the ribs 4 and 6 are formed on the outer face, moreover, their PC steel bars 2 and 9 can be effective to provide a shelter structure which is firm against an external force. Since the unit 5 constructed of the paired unit half plates 3 has a multiplanar section, furthermore, it is possible to form concrete into a unit half plate 3 which has an arch half suited for the windings, undulations and grades of the road.

Figure 4:
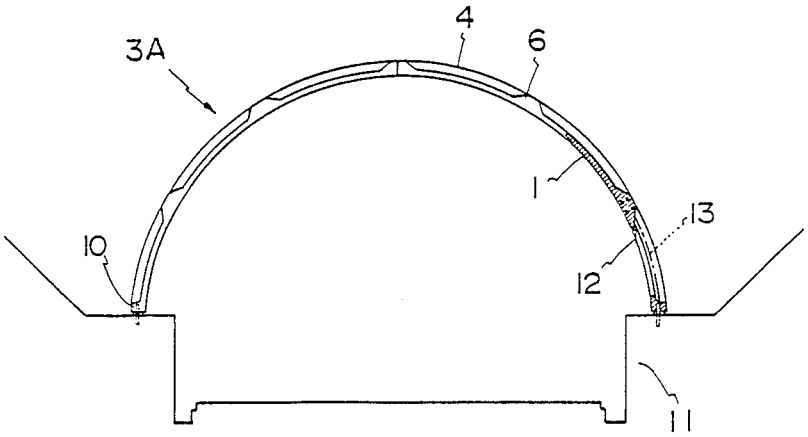
FIG. 4 is similar to FIG. 1 but shows a second embodiment of the present invention.
Figure 5:
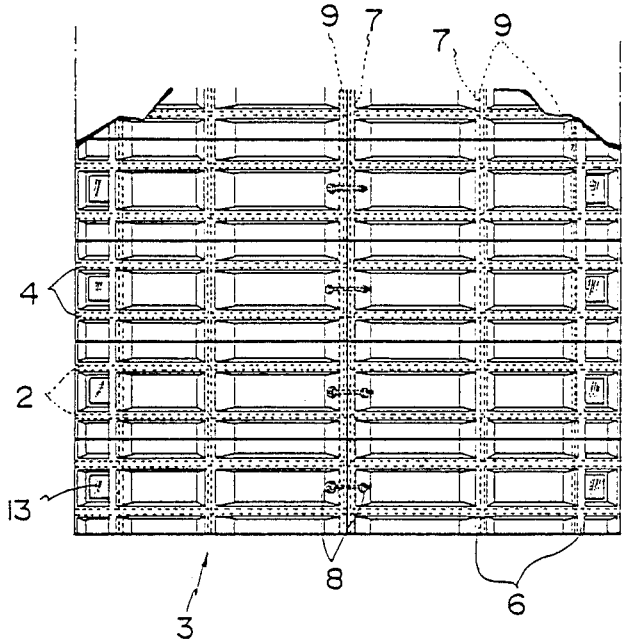
FIG. 5 is similar to FIG. 2 but shows the PC shelter structure of FIG. 4.

Turning to FIGS. 4 and 5, a second embodiment of the present invention will be described by denoting the same portions as those of FIGS. 1 to 3 at the common reference numerals. In this embodiment, each pair of PC unit half plates 3A, which are to be fastened together by the transversely fastening PC steel bars 9 into the arched shelter structure, have not the multi-planar section, as in the foregoing embodiment, but a generally continuously curving section. Each unit half plate 3A is arranged with at least one aperture 12, in which there is fitted a transparent or semitransparent face plate 13 of a synthetic resin from the outer or inner face through a not-shown suitable member to provide a natural lighting window.

Here, the unit half plate 3A may also be formed on either its inner face or its inner and outer faces with ribs 4 and 6 to be arranged with the PC steel bars 2 and 9. Moreover, the generally arched unit may have their two ends or legs 10 fixed rigidly in the field to not-numbered posts which are also prefabricated at the factory.

Figure 7:
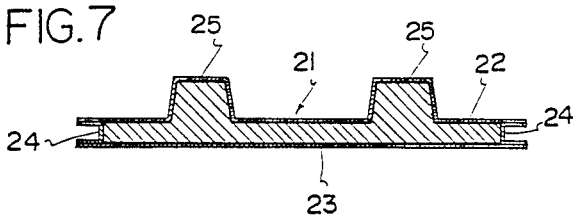
FIG. 7 is an enlarged transversely sectional side elevation of the arching form of FIG. 6.
Figure 8:
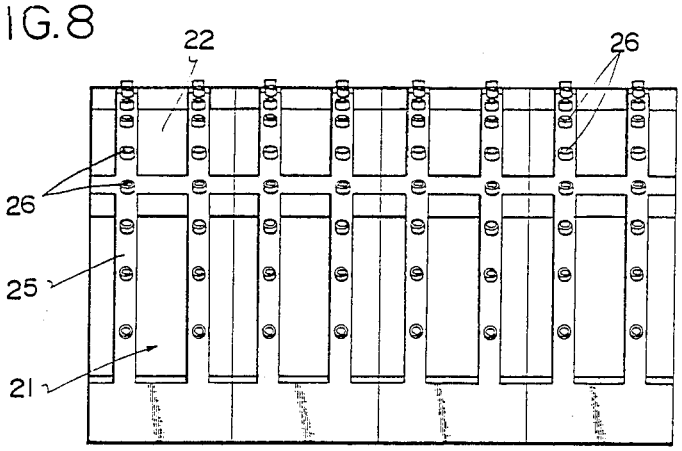
FIG. 8 is a side elevation showing the case in which four arching forms of FIGS. 6 and 7 are arranged side by side in the longitudinal direction of the resultant PC shelter structure.
Figure 9:
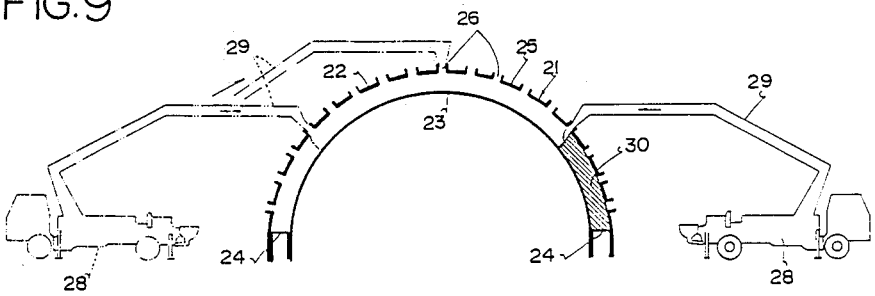
FIG. 9 is similar to FIG. 6 but schematically shows the arching form which is being placed with concrete by the process of FIGS. 6 to 8.
Figure 10:
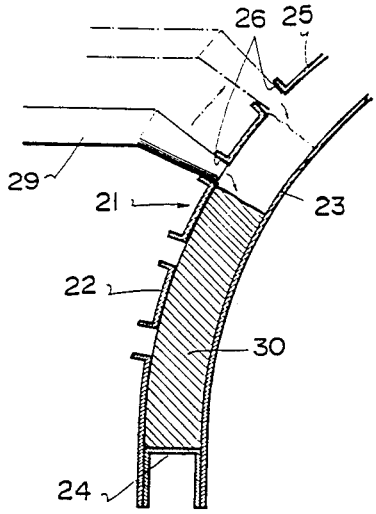
FIG. 10 is an enlarged longitudinal section showing a portion of the arching form of FIGS. 6 to 8.

Turning now to FIGS. 6 to 10, there is shown a process for prefabricating the unit half plates 3 and 3A of FIGS. 1 to 5 in accordance with a third embodiment of the present invention. An arching form 21 is constructed by assembling a top form frame 22, a bottom form frame 23 and side form frames 24 by not-shown fastening means. The top form frame 22 is formed with two rows of, for example, peripheral rib forming portions 25, each of which in turn is formed with seventeen placing ports 26 at an equal interval. Reference numeral 27 denotes an erection structure for supporting the arching form 21 thus constructed. As in the prior art, the concrete is stored in the not-numbered tank of a concrete pump car 28. In a place near the factory or field, as shown in FIG. 9, the placing pipe 29 of the concrete pump car 28 is at first connected to the lowermost placing port 26 of one side of the arching form 21 to pump the concrete 30 via the placing pipe 29 into the arching form 21 up to the level of the lowermost placing port 26 by the action of the concrete pump. Then, the placing pipe 29 is disconnected from the lowermost placing port 26, and this placing port 26 is sealed with a not-shown cover. In this state, the concrete 30 is pumped into the arching form 21 up to the level of a next placing port 26. Thus, the concrete 30 is placed into one side of the arching form 21 consecutively from lower to higher placing ports 26. After this, the concrete 30 is likewise placed into the other side of the arching form 21. Finally, the concrete 30 is further placed into the highest or top placing port 26. Here, a top form plate 31 is positioned at the peripheral center of the top placing port 26 so that the generally arched unit may be divided into two half plates 3 (of the first embodiment) or 3A (of the second embodiment). The positioning of the top form plate 31 may be conducted either before or immediately after the placing of the concrete 30 into the top form plate 31. It should also be noted that suitable inserts 32 (for the ducts 7 of FIGS. 2 and 4) and not-shown suitable inserts (for the peripheral fasteners 8) are positioned in advance in the arching form 21. Meanwhile, the compaction of the concrete is carried out in time to the pumping action of the concrete pump car 28 by means of a high-frequency vibrator for vibrating the arching form 21.

Thus, in the process of this third embodiment, the placing pipe 29 of the concrete pump car 28 is connected to the several placing ports 26 one after another. These placing ports 26 are formed in the top form frame 22 of the arching form 21 to pump and place the concrete 30 sequentially from the bottom to the top of the arching form 21. As better seen from FIG. 10, therefore, the space of the single placing action is restricted to a small one between the two adjacent placing ports 26 with a small head. This causes the air to move up sequentially upward, thus preventing it from being left confined in the concrete 30 and this concrete 30 itself from segregating. Since, moreover, the concrete pump car 28 has its placing pipe 29 connected to the placing ports 26 one after another to sequentially pump the concrete 30 directly into the arching form 21 by its concrete pump, it can complete the concrete placing of the arching frame 21 within a short period of time. Thus, it is possible to construct an arched PC shelter structure which is voidless and excellent in strength and appearance.

Figure 6:
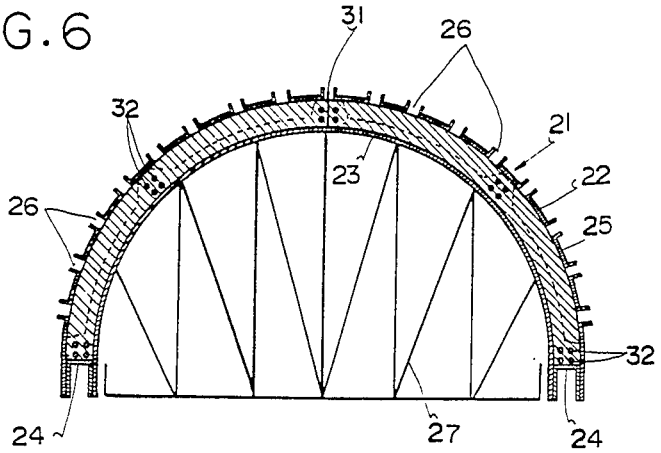
FIG. 6 a longitudinally sectional front elevation showing an arching form for prefabricating the unit half plates in a pair by a process according to a third embodiment of the present invention.

On the other hand, the number and interval of the placing ports 26 may be appropriately selected. In short, the arching form 21 may be equipped with the placing ports 26 in its right and left sides and its top to place the concrete 30 sequentially from its bottom to the top. In FIGS. 6 to 8, moreover, the placing ports 26 are formed in the rib forming portions 25 of the top form frame 22 but may be formed between the portions 25. In short, it is sufficient that the placing ports 26 are formed in the top form frame 22. Still moreover, the rib forming portions 25 of the top form frame may be omitted but may be formed in the bottom form frame 23. On the other hand, the arched shelter structure can fit all the shapes including the arched multiplanar one. As described above, the placing ports 26 may be used in the order from the right and left side ones to top one, and this order can be appropriately selected within the exemplified range. On the other hand, the placing pipe 29 to be used with the concrete pump car 28 may employ suitable means of piping or boom type. Suitable means may be selected for connecting the placing pipe 29 to one of the placing ports 26. These placing ports 26 need not be formed with the projecting mouths, as shown. By the process thus far described, it is possible to prefabricate pairs of excellent PC unit half plates for the arched PC shelter structure.

Figure 11:
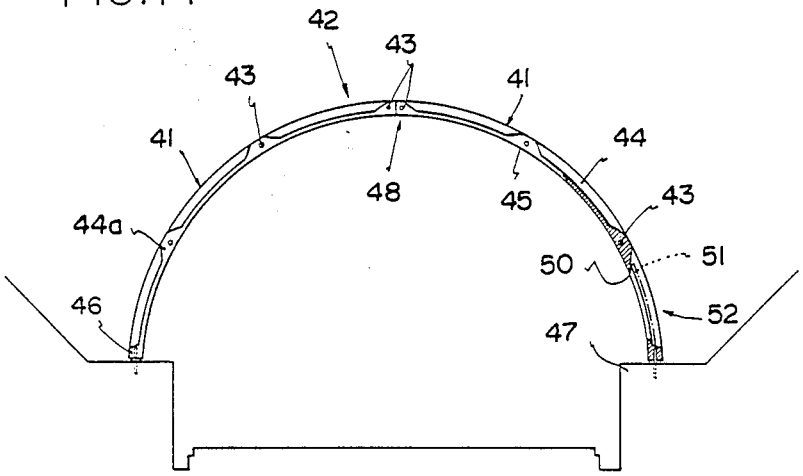
FIG. 11 is similar to FIGS. 1 and 4 but shows an arched PC shelter structure according to a fourth embodiment of the present invention.
Figure 12:
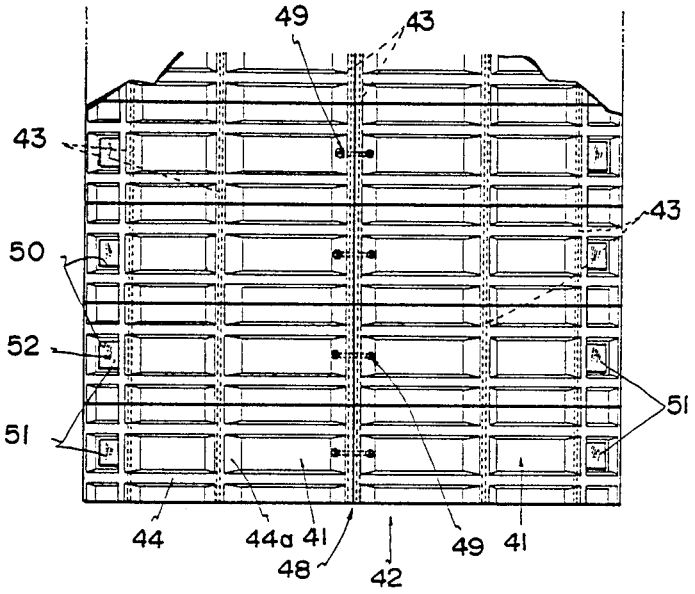
FIG. 12 is similar to FIGS. 2 and 5 but shows the PC shelter structure of FIG. 11.
Figure 13:
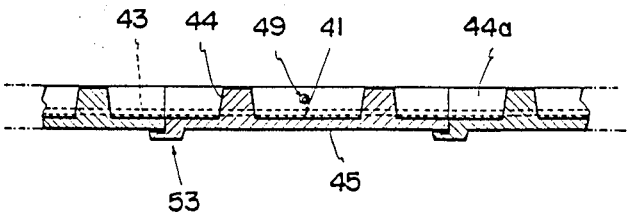
FIG. 13 is an enlarged longitudinal section showing a portion of the PC shelter structure of FIGS. 11 and 12.

According to a fourth embodiment of the present invention, as shown in FIGS. 11 to 13, a number of unit half plates 41 are prefabricated of highly strong concrete at a factory. These unit half plates 41 are paired and assembled together in the field to form generally arched units 42. These arched units 42 are then assembled in abutting states and fastened in the longitudinal direction of the resultant arched PC shelter structure by means of a plurality of fastening PC steel bars 43, e.g., unbonded PC steel bars which are arranged at a predetermined interval. Moreover, each of the unit half plates 41 has its outer face formed with peripheral or longitudinal ribs 44 and transverse ribs 44*a* and its inner face 45 curving generally continuously. The aforementioned PC steel bars 43 extend through the transverse ribs 44*a*. Here, these PC steel bars 43 are exemplified by the prestressed concrete steel bars or the unbonded PC steel bars which are covered with asphalt or tar so that they may not be wetted with the concrete, but may be the post-tension PC steel bars using sheaths. On the other hand, the unit half plate 41 may be prefabricated of highly strong concrete reinforced with fibers. Moreover, the paired unit half plates 41 have their lower ends or legs 46 hinged to foundations 47 by means of supports and anchor bolts and their abutting top ends 48 fastened by means of a peripheral fastener 49 such as a combination of a bolt and a nut. Incidentally, the unit half plate 41 is arranged therein with at least one aperture 50, in which there is fitted a transparent or semi-transparent face plate 51 from the outer or inner face through suitable means such as a retaining or fitting member to form a natural lighting window 52. Reference numeral 53 appearing in FIG. 13 denotes a side flange which is formed to extend from the inner face of the transversely abutting portion of each unit half plate 41 thereby to cover the abutting portion.

In the fourth embodiment described above, the unit half plates 41 are prefabricated in pairs of the highly strong concrete to form the generally arched units 42, which are then assembled in the longitudinal direction of the desired arched PC shelter structure to have their unit half plates 41 fastened by mean of the transversely fastening PC steel bars 43. Moreover, the unit half plate 41 has its outer face formed with the crossing ribs 44 and 44*a* extending in the curving and transverse directions and its inner face curving generally continuously. As a result, the light-weight arched PC shelter structure can be easily laid and erected in the field without substantially blockading the traffic to reduce the costs for its maintenance and repairs. Since, moreover, the numerous unit half plates 41 can be fastened by the transverse PC steel bars 43, the arched PC shelter structure to be constructed can be made firm. Furthermore, the inner face of the shelter structure is the continuously curving face 45 so that it can present a fine view, and the natural lighting windows 52 can present a well-lighted space in the arched shelter structure. In addition, the ribs 44 and 44*a* are formed on the outer face to facilitate the mounting and fastening of the transverse PC steel bars 43.

The present invention should not be limited to the four embodiments thus far described but can be modified in various manners within the gist of itself.

I claim:

1. A generally arched, prefabricated PC shelter structure comprising: a plurality of pairs of unit half plates prefabricated of highly strong concrete, any paired two of said unit half plates being peripherally curved to form a generally arched unit together when they are assembled to have their tops abutting against each other; peripheral fastening means for peripherally fastening the abutting tops of said paired two unit half plates together to form said generally arched unit; transverse fastening means including at least one unbonded PC steel bar buried in a plurality of generally arched units, which are arranged side by side, for transversely fastening the same together to construct a generally arched PC shelter structure; anchor means for anchoring the legs of said paired two unit half plates to foundations, said anchor means including one of:

a support mounted on one of said foundations, a plurality of anchor bolts and a hinge for hinging one of the legs of said each unit half plate to said one foundation through said anchor bolts;

and a concrete hinge preformed in one of the legs of said each unit half plate so that it may be buried in one of said foundations;

and peripheral reinforcing means buried in each of said unit half plates and including at least one unbonded PC steel bar for peripherally tensioning and reinforcing said each unit half plate.

2. A generally arched, prefabricated PC shelter structure as set forth in claim 1, wherein each of said unit half plates includes at least one of: at least one peripheral rib formed thereon; and at least one transverse rib formed thereon.

3. A generally arched, prefabricated PC shelter structure as set forth in claim 1, wherein said peripheral rib and said transverse rib extend on one of the outer and inner face of said each unit half plate.

4. A generally arched, prefabricated PC shelter structure as set forth in claim 1, wherein said unbonded PC steel bar is one of a PC steel bar coated with a lubricant selected from the group consisting of asphalt and tar, and a post-tension PC steel bar using a sheath.

5. A generally arched, prefabricated PC shelter structure as set forth in claim 1, wherein each of said unit half plates has one of:

its inner and outer faces formed with a plurality of planes so that the generally arched unit formed together with a pairing unit half plate has a generally arched multiplanar section; and, a generally continuously curving section so that the generally arched unit formed together with a pairing unit half plate also has a generally continuously curving section.

6. A generally arched, prefabricated PC shelter structure as set forth in claim 1, wherein said peripheral fastening means includes a combination of a bolt and a nut.

7. A generally arched, prefabricated PC shelter structure as set forth in claim 1, wherein said unbonded PC steel bar is one of a PC steel bar coated with a lubricant selected from the group consisting of asphalt and tar, and a post-tension PC steel bar using a sheath.

8. A generally arched, prefabricated PC shelter structure as set forth in claim 1, wherein each of said unit half plates includes: at least one aperture; and at least one semitransparent face plate fitted in said aperture for providing a natural lighting window.

9. A generally arched, prefabricated PC shelter structure as set forth in claim 1, wherein each of said unit half plates includes a side flange extending from the inner face of the transversely abutting portion thereof to cover said abutting portion.

10. A pair of unit half plates prefabricated of highly strong concrete and curved peripherally to form a generally arched unit together, when they are fastened at their tops abutting against each other, thereby to construct a generally arched PC shelter structure when a plurality of generally arched units are arranged side by side and fastened transversely together, each of said unit half plates comprising at least one of:

at least one peripheral rib formed thereon extending on the outer or inner face thereof;

peripherally reinforcing means including an unbonded PC steel bar buried through said peripheral rib for peripherally tensioning and reinforcing said each unit half plate;

at least one transverse rib formed thereon; and, its inner and outer faces formed with a plurality of planes to that said generally arched unit has a generally arched multiplanar section; and a generally continuously curving section so that said generally arched unit also has a generally continuously curving section.

11. A pair of unit half plates as set forth in claim 10, wherein said unbonded PC steel bar is one of a PC steel bar coated with a lubricant selected from the group consisting of asphalt and tar, and a post-tension PC steel bar using a sheath.

12. A pair of unit half plates as set forth in claim 10, wherein said peripheral rib and said transverse rib extend on the outer or inner face of said each unit half plate.

13. A pair of unit half plates as set forth in claim 10, each having its abutting top formed with a peripheral through hole in which fastening means is threaded to the peripheral through hole of the other.

14. A pair of unit half plates as set forth in claim 10, each further comprising: at least one aperture; and at least one semitransparent face plate fitted in said aperture for providing a natural lighting window.

15. A pair of unit half plates as set forth in claim 10, each further comprising a side flange extending from the inner face of the transversely abutting portion thereof to cover said abutting portion when it is arranged side by side with a transversely adjacent unit half plate and fastened transversely together.

16. A process for prefabricating together a pair of unit half plates of highly strong concrete, which are curved peripherally to form a generally arched unit together, when they are fastened at their tops abutting against each other, thereby to construct a generally arched PC shelter structure when a plurality of generally arched units are arranged side by side and fastened transversely together, comprising the steps of:

(a) pumping highly strong concrete into an arching form, which is assembled from a top frame, a bottom frame and side frames to have both an internal space for forming said generally arched unit and a plurality of placing ports arranged peripherally on said top form frame at a predetermined interval and opened into said internal space, through the lowermost one of said placing ports at one side substantially up to the level of said lowermost placing port;

(b) covering said lowermost placing port;

(c) pumping said concrete into said arching form through the next one of said placing ports substantially up to the level of said next placing port;

(d) covering said next placing port;

(e) repeating the pumping step (c) and the subsequent covering step (d) at said one side except for the top placing port (f) repeating the steps (a) to (e) consecutively for the other side of said arching form;

(g) positioning a top form plate at the peripheral center of said top placing port; and (h) pumping said concrete into said arching form through said top placing port.

17. A process as set forth in claim 16, wherein said top placing port has at least one peripheral through insert for forming across the abutting tops of said unit half plates a peripheral through hole, through which a peripheral fastening means is threaded for peripherally fastening said unit half plates together.

18. A process as set forth in claim 16, wherein said arching form has: at least one row of peripheral rib forming portion formed on said top form frame for forming a corresponding peripheral rib on the outer face of said generally arched unit and for arranging said placing ports peripherally thereon; and at least one row of transverse rib forming portion formed on said top form frame for forming a corresponding transverse rib on the outer face of said generally arched unit.

19. A process as set forth in claim 18, wherein said peripheral rib forming portion has at least one peripheral through insert for forming a peripheral through hole, through which a peripheral reinforcing means is threaded for peripherally reinforcing said unit half plates.

20. A process as set forth in claim 18, wherein said transverse rib forming portion has at least one transverse through insert for forming a transverse through hole, through which a transverse fastening means is threaded for transversely fastening said generally arched units together.

21. A process as set forth in claim 16, wherein said top form frame and said bottom form frame have one of:

their inner faces formed with a plurality of planes so that said generally arched unit may have a generally arched multiplanar section; and, or generally continuously curving inner faces so that said generally arched unit may have a generally continuously curving section.

22. A process as set forth in claim 16, wherein said arching form has at least one core sized and shaped to form a corresponding aperture in said generally arched unit.

23. A process as set forth in claim 16, wherein said bottom form frame has a recess positioned and shaped to form a side flange extending from the inner face of the transversely abutting portion of each of said unit half plates.

24. A method of erecting a generally arched PC shelter structure in the field, comprising the steps of:

temporarily assembling a plurality of pairs of unit half plates, which are prefabricated of highly strong concrete with at least one unbonded steel bar, such that any paired two of said unit half plates have their tops abutting against each other to form a generally arched unit together;

fastening any paired two of said unit half plates to each other at their tops in their curving longitudinal direction by means of a combination of a bolt and a nut;

fixing said unit half plates adjoining side by side to each other in their transverse direction by threading a plurality of PC steel bars thereinto and by fastening the same; and anchoring the legs of said paired two unit half plates to foundations.

* * * * *